US009573742B1

(12) United States Patent
Schmid

(10) Patent No.: US 9,573,742 B1
(45) Date of Patent: Feb. 21, 2017

(54) TIME CAPSULE WITH CLANDESTINE KEY

(71) Applicant: Rudolf F. Schmid, Dayton, MD (US)

(72) Inventor: Rudolf F. Schmid, Dayton, MD (US)

( * ) Notice: Subject to any disclaimer, the term of this patent is extended or adjusted under 35 U.S.C. 154(b) by 0 days.

(21) Appl. No.: 15/057,517

(22) Filed: Mar. 1, 2016

(51) Int. Cl.

| | |
|---|---|
| ***B65D 55/14*** | (2006.01) |
| ***B65D 25/54*** | (2006.01) |
| ***B65D 25/04*** | (2006.01) |
| ***B65D 43/22*** | (2006.01) |
| ***B65D 25/28*** | (2006.01) |
| ***B65D 43/16*** | (2006.01) |

(52) U.S. Cl.
CPC ..... *B65D 55/14* (2013.01); *B65D 25/04* (2013.01); *B65D 25/282* (2013.01); *B65D 25/54* (2013.01); *B65D 43/16* (2013.01); *B65D 43/22* (2013.01)

(58) Field of Classification Search
CPC ..... B65D 55/14; B65D 25/04; B65D 25/282; B65D 25/2802; B65D 1/24; B65D 43/16; B65D 43/22; B65D 9/32
USPC ..... 220/662, 377, 504, 503, 526, 523, 625, 220/505, 210, 554, 555, 553, 500; 217/7, 217/18; 206/223, 216
See application file for complete search history.

(56) References Cited

U.S. PATENT DOCUMENTS

| | | | | |
|---|---|---|---|---|
| 1,354,211 | A * | 9/1920 | Reed | B65D 25/04 206/38 |
| 1,674,352 | A * | 6/1928 | Adams | F41C 33/06 190/28 |
| 1,956,958 | A * | 5/1934 | Mertel | E05G 1/026 109/59 R |
| 4,662,519 | A | 5/1987 | Ciociola | |
| 4,665,668 | A | 5/1987 | Serpico | |
| D330,818 | S | 11/1992 | Brandt | |
| D338,317 | S | 8/1993 | Woodward | |
| D338,329 | S | 8/1993 | Cornwall | |
| 5,238,137 | A | 8/1993 | Cornwall | |
| 5,312,008 | A | 5/1994 | Davis | |
| D386,112 | S | 11/1997 | Wolf | |
| 5,810,364 | A | 9/1998 | Canion | |
| 2010/0121989 | A1 | 5/2010 | Morris | |
| 2010/0234981 | A1 | 9/2010 | Turner | |

* cited by examiner

*Primary Examiner* — Robert J Hicks
(74) *Attorney, Agent, or Firm* — Dale J. Ream

(57) ABSTRACT

A time capsule includes a housing having a floor and an upper side wall extending upwardly from the floor and a lower side wall extending downwardly from the floor. The floor and the at least one upper side wall together define an upper chamber. The floor and the at least one lower side wall together define a lower chamber. A bottom wall is fixedly attached to lower edges of the at least one lower side wall so as to block access to the lower chamber. A lid is coupled to upper edges of the at least one upper side wall, the lid movable between an open configuration allowing access to the upper chamber and a closed configuration blocking access to the upper chamber, the lid having a lock that holds the lid at the closed configuration until unlocked with a key situated in the lower chamber.

13 Claims, 10 Drawing Sheets

TIME CAPSULE WITH CLANDESTINE KEY

BACKGROUND OF THE INVENTION

This invention relates generally to time capsules and, more particularly, to a time capsule that, when locked shut, can only be opened by breaking into a lower chamber and retrieving the key that will open the lock.

A time capsule is a collection of items gathered into a container of some sort that is intended to be opened at some future date as a method of communicating to future people about the state of events or things in the past. Historically, time capsules have been used to store items that indicate the then-current state of technology, photographs, recordings, and other elements of historic significance or general nostalgia. The time capsule may be buried in the ground, laid in the foundation of a building, or stored in a government building where it is likely to be preserved. Instructions regarding the location of the time capsule and regarding when it is to be opened may also be left or communicated to government officials to increase the likelihood of being passed down—sometimes for generations.

Although time capsules, in general, have been well known for hundreds of years, they are not effectively used in the context of a family to pass down family heirlooms, historical family records, photographs, and other nostalgic articles particular to the family. In addition, there is no effective way to secure the stored items from being disturbed while also making them accessible at the appointed time in which the time capsule is intended to be opened.

Therefore, it would be desirable to have a family time capsule in which special family items may be stored and secured in a locked environment while still providing a means for unlocking the time capsule at a predetermined time in the future. Further, it would be desirable to have a family time capsule in which a literal key to unlock a locking assembly securing the housing is secured in a clandestine location within the housing and can only be accessed by breaching a barrier.

SUMMARY OF THE INVENTION

A time capsule according to the present invention includes a housing having a floor and at least one upper side wall extending upwardly from a peripheral edge of the floor and at least one lower side wall extending downwardly from the peripheral edge of the floor. The floor and the at least one upper side wall together define an upper chamber. The floor and the at least one lower side wall together define a lower chamber. A bottom wall is fixedly attached to lower edges of the at least one lower side wall so as to block access to the lower chamber. A lid is coupled to upper edges of the at least one upper side wall, the lid movable between an open configuration allowing access to the upper chamber and a closed configuration blocking access to the upper chamber, the lid having a lock that holds the lid at the closed configuration until unlocked with a key, the key being situated in the lower chamber and configured to release the lock.

Therefore, a general object of this invention is to provide a time capsule for receiving articles, such as family heirlooms, photographs, and memorial items, in a locked chamber until a scheduled date in which a key to the capsule must be broken free in the base of the capsule to unlock the capsule.

Another object of this invention is to provide a time capsule that remains unlocked until filled with articles and is then manually locked by a user only to be unlocked at a designated day in the future by breaking the bottom wall and retrieving the key.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
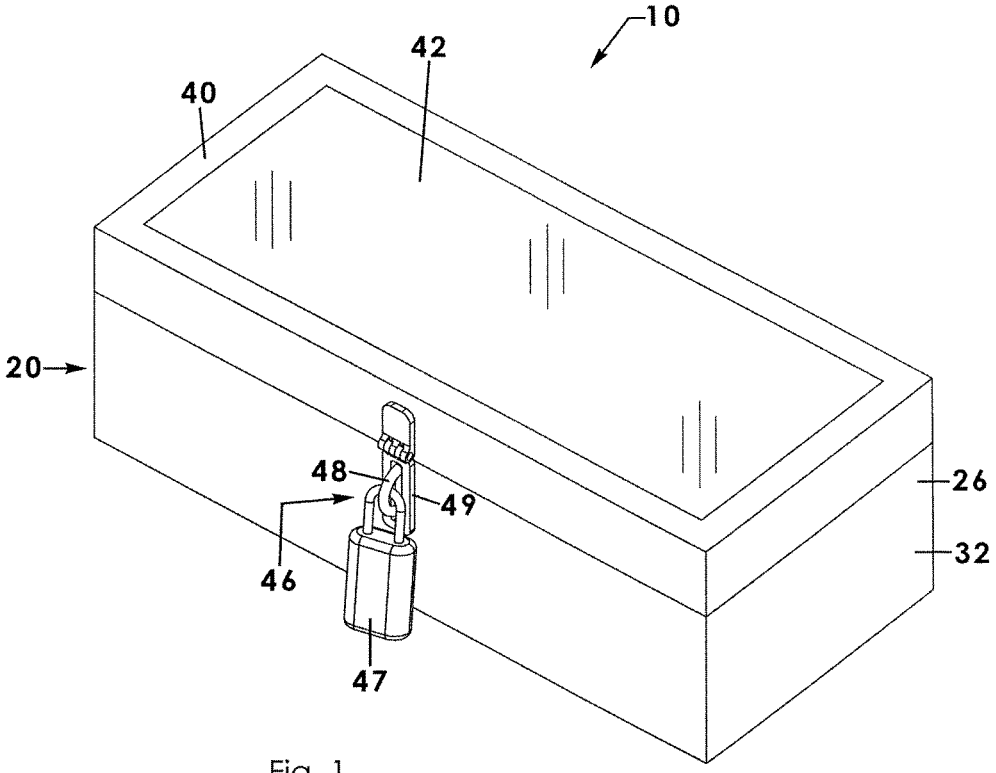
FIG. 1 is a perspective view of a time capsule according to a preferred embodiment of the present invention, illustrated in a closed and locked configuration.
Figure 2:
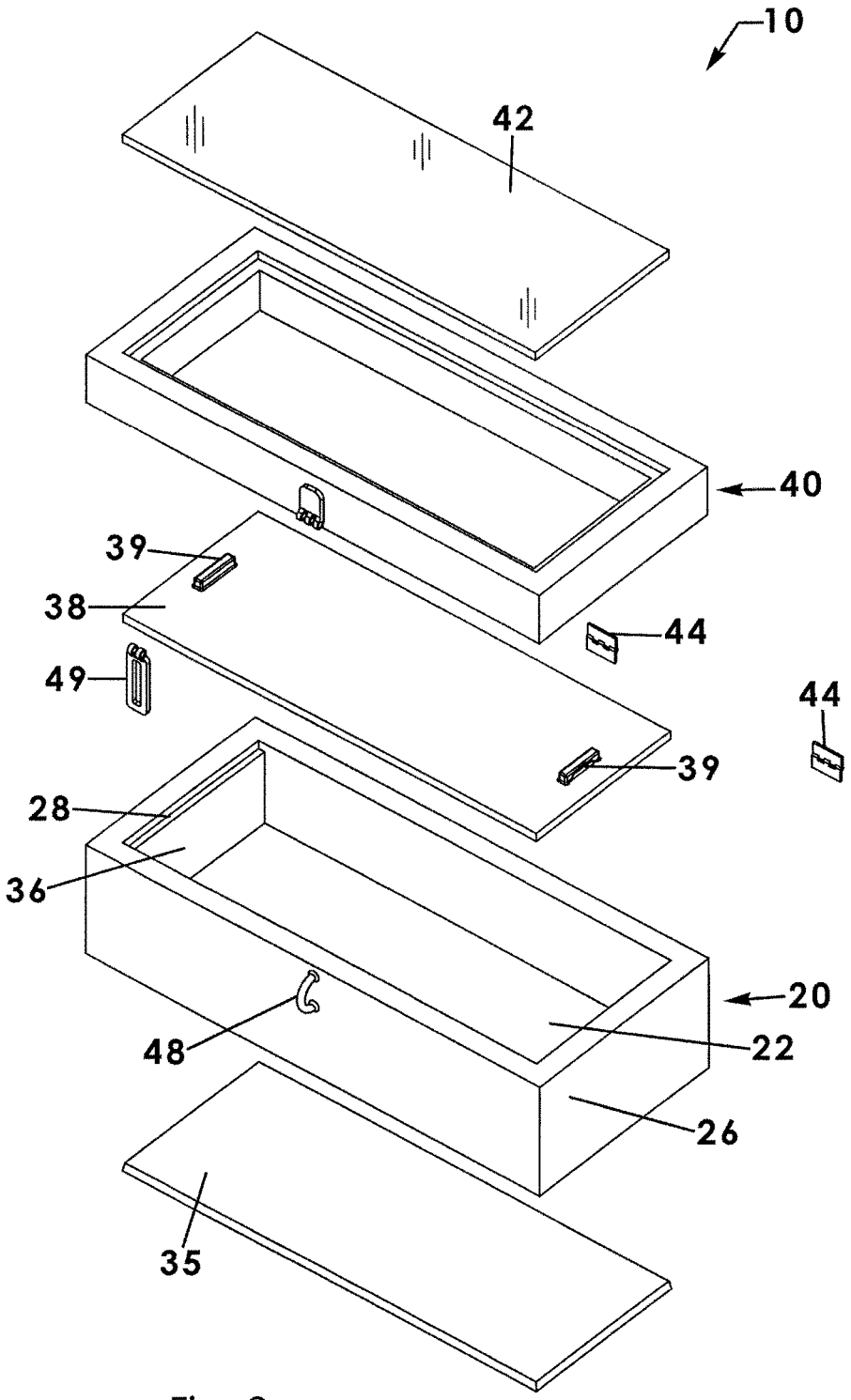
FIG. 2 is an exploded view of the time capsule as in FIG. 1.

A time capsule according to a preferred embodiment of the present invention will now be described in detail with reference to FIGS. 1 to 10*c* of the accompanying drawings. The time capsule 10 includes a housing 20 defining an upper chamber 30, a lower chamber 34, and a key 50 that is clandestinely positioned in the lower chamber 34.

The housing 20 of the time capsule 10 includes a floor 22 and at least one upper side wall 26 extending upwardly from a peripheral edge 24 of the floor 22. Similarly, at least one lower side wall 34 extends downwardly from the peripheral edge 24 of the floor 22. Together, the floor 22 and upper side wall 26 define an open space that will be referred to as an upper chamber 30. Likewise, the floor 22 and lower side wall 34 define an open space that will be referred to as an lower chamber 34. Accordingly, the floor 22 is sandwiched in between the upper chamber 30 and lower chamber 34. Preferably, the upper chamber 30 has a larger geometric volume than the lower chamber 34 for reasons discussed later.

In an embodiment (not illustrated), a single continuous upper side wall 26 may extend upwardly from the floor 22 such that the housing 20 may have a circular, cylindrical, oval, conical, or similar configuration. Preferably, however, a plurality of upper side walls 26 extend upwardly from the peripheral edges 24 of the floor 22 and a plurality of lower side walls 34 extend downwardly in like manner. Accordingly, the housing 20 may have a generally rectangular configuration (illustrated in the figures) like a box, although the configuration may have a square configuration or the like.

Figure 6:
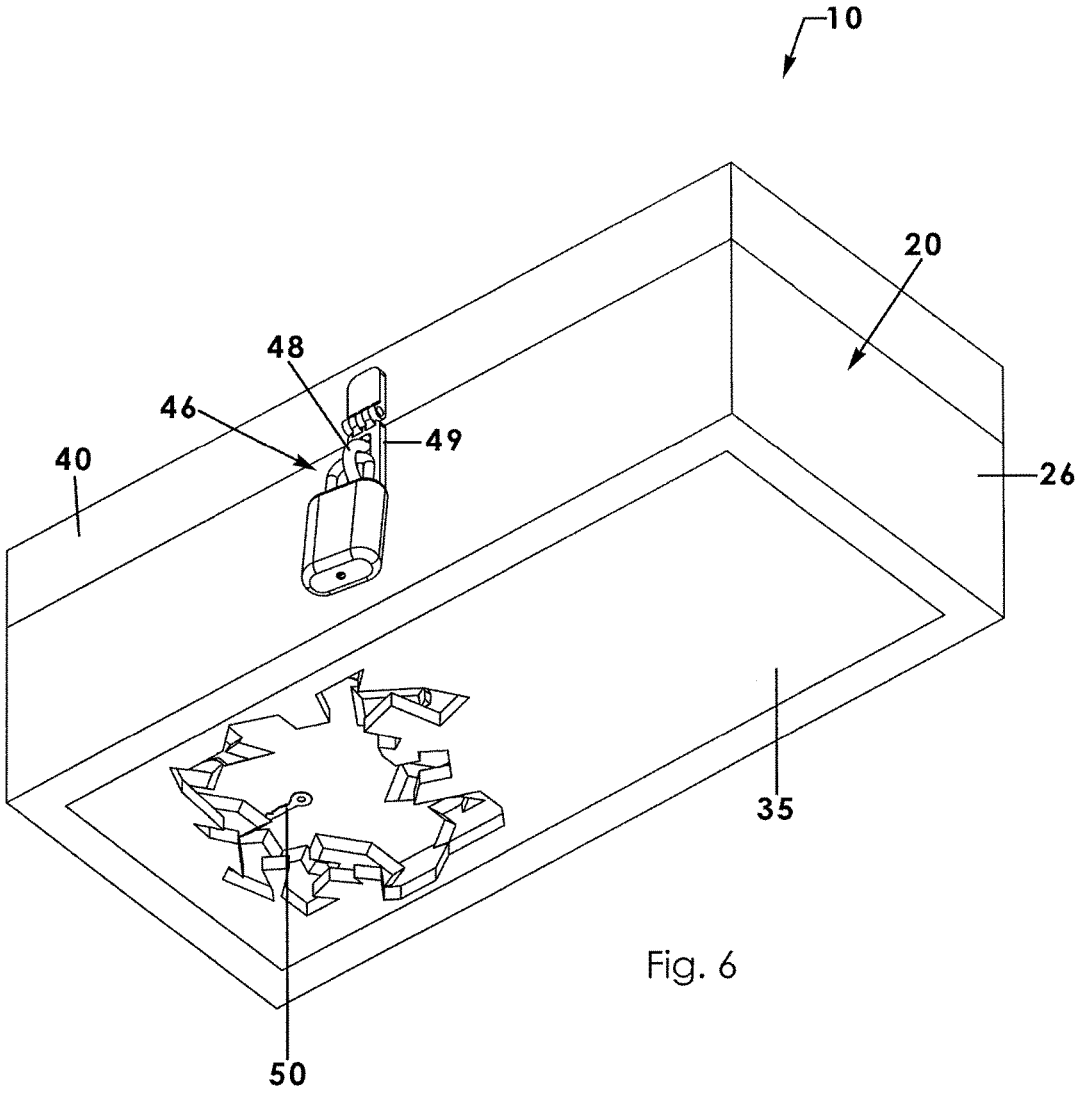
FIG. 6 is a perspective view of the time capsule as in FIG. 5, illustrated with the bottom wall broken open.
Figure 7:
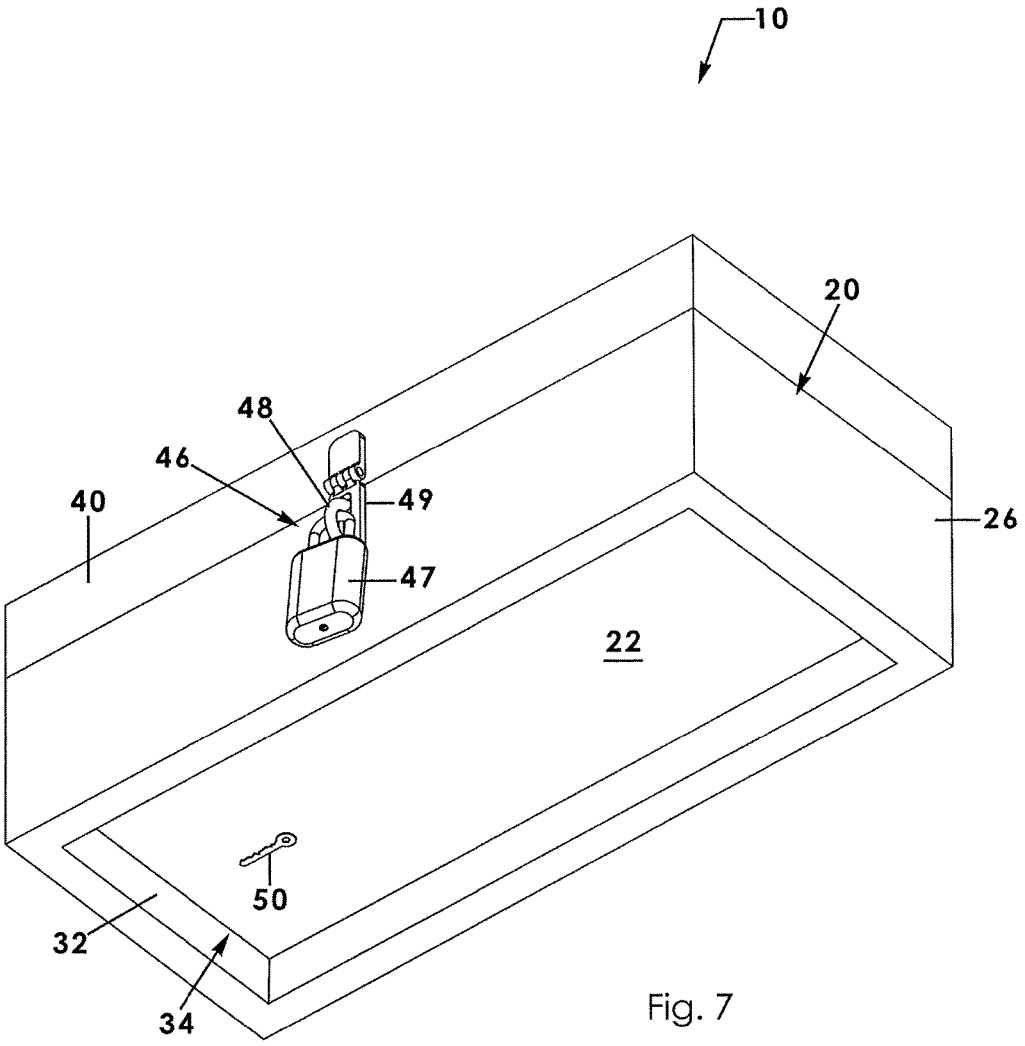
FIG. 7 is a perspective view of the time capsule as in FIG. 5, illustrated with the bottom wall completely removed from the housing for clarity in showing the lower chamber.
Figure 8A:
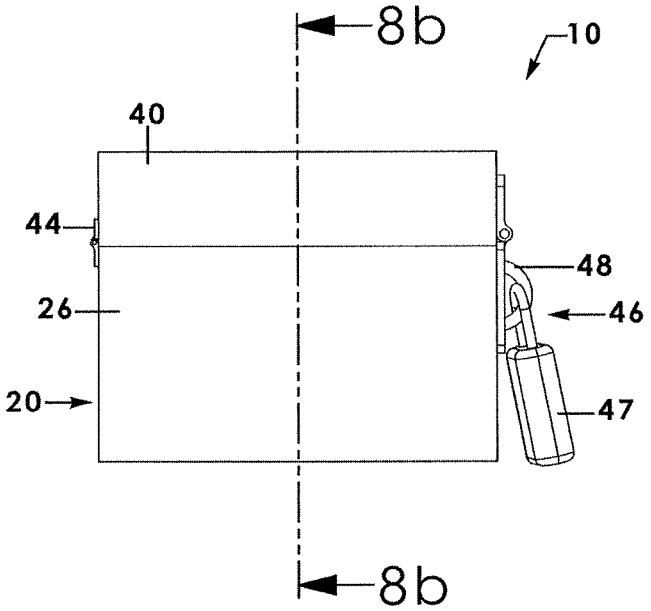
FIG. 8*a* is a side view of the time capsule as in FIG. 1.
Figure 8B:
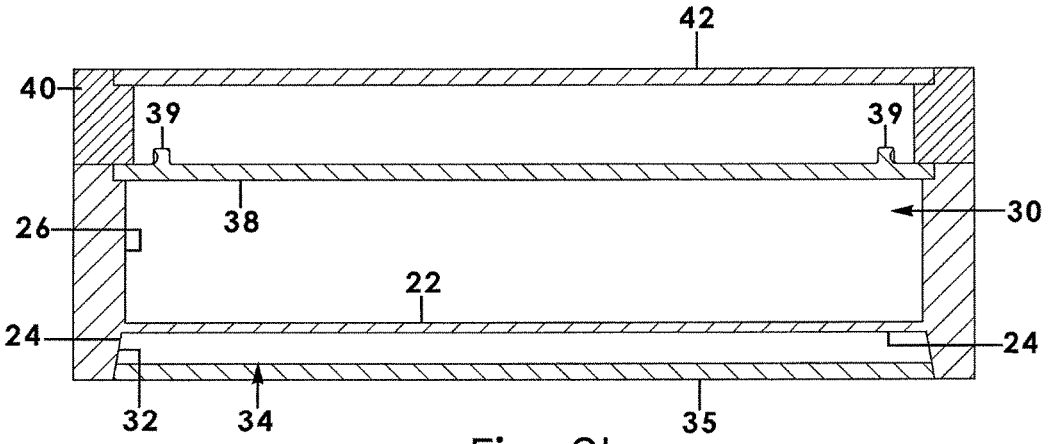
FIG. 8*b* is a sectional view taken along line 8*b*-8*b* as in FIG. 8*a;*
Figure 9A:
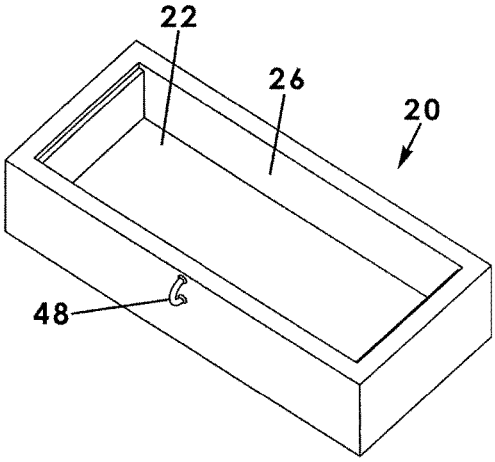
FIG. 9*a* is a perspective view of the housing as in FIG. 1.
Figure 9B:
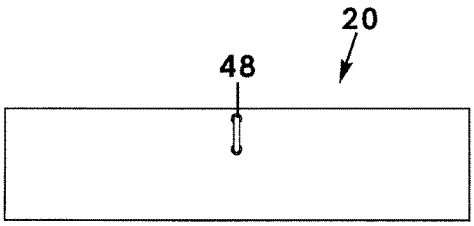
FIG. 9*b* is a front view of the housing as in FIG. 9*a;*
Figure 9C:
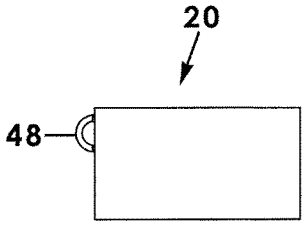
FIG. 9*c* is a side view of the housing as in FIG. 9*a;*
Figure 10A:
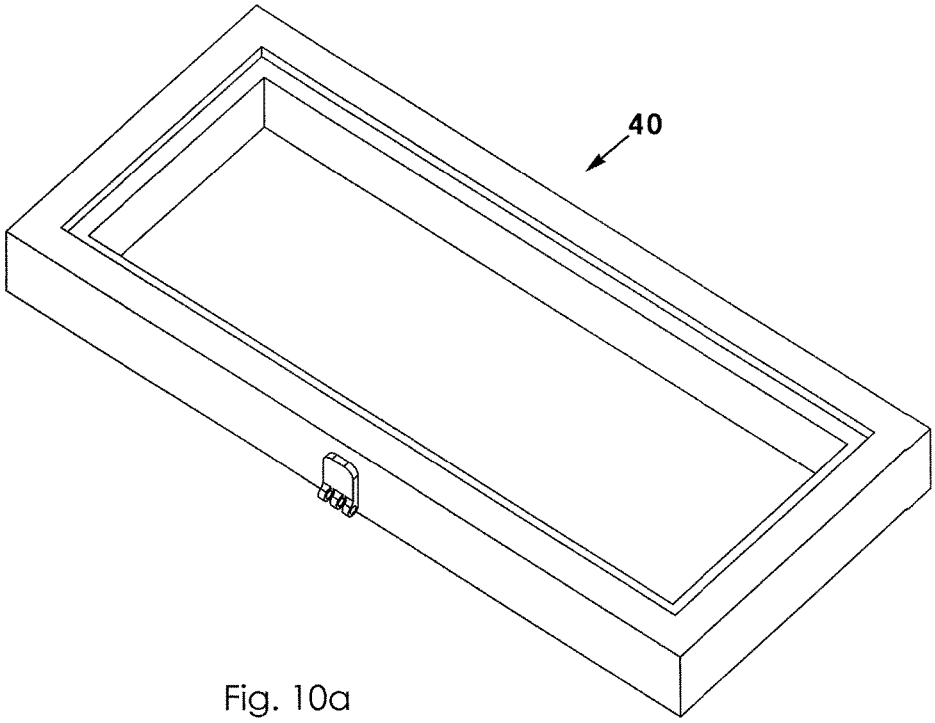
FIG. 10*a* is a perspective view of the lid as in FIG. 3.
Figure 10B:
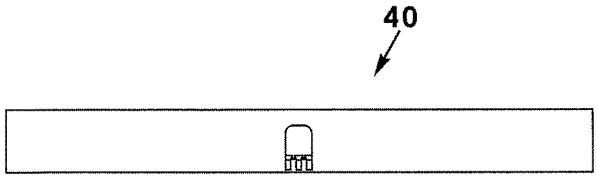
FIG. 10*b* is a front view of the lid as in FIG. 10*a*.
Figure 10C:
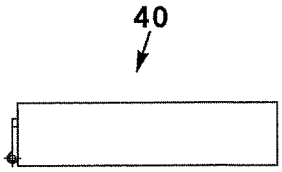
FIG. 10*c* is a side view of the lid as in FIG. 10*a.*

A bottom wall 35 is coupled to lower (distal) edges of the lower side walls 32 and extends completely therebetween so as to block or prevent access to the lower chamber 34. In other words, the lower chamber 34 may be sealed against access from the point of manufacture or, alternatively, at a point of assembly by a user. In either case, a key 50 may be positioned in the lower chamber 34 before the bottom wall 35 is attached and situated to block access into the lower chamber 34. Preferably, the bottom wall 35 is constructed of a thin, wooden material that is not sturdy to withstand breakage. In other words, it is anticipated that the bottom wall 35 may be broken, severed, or otherwise breached by a person, whether he uses his own hands, a hammer, knife, screwdriver, or the like (FIG. 6). For example, the bottom wall 35 may be constructed of Balsa wood—which is well known for being soft, light, and easy to break. The bottom wall may be breached so as to access the key 50 inside the lower chamber 34 as will be described in more detail later.

Figure 4:
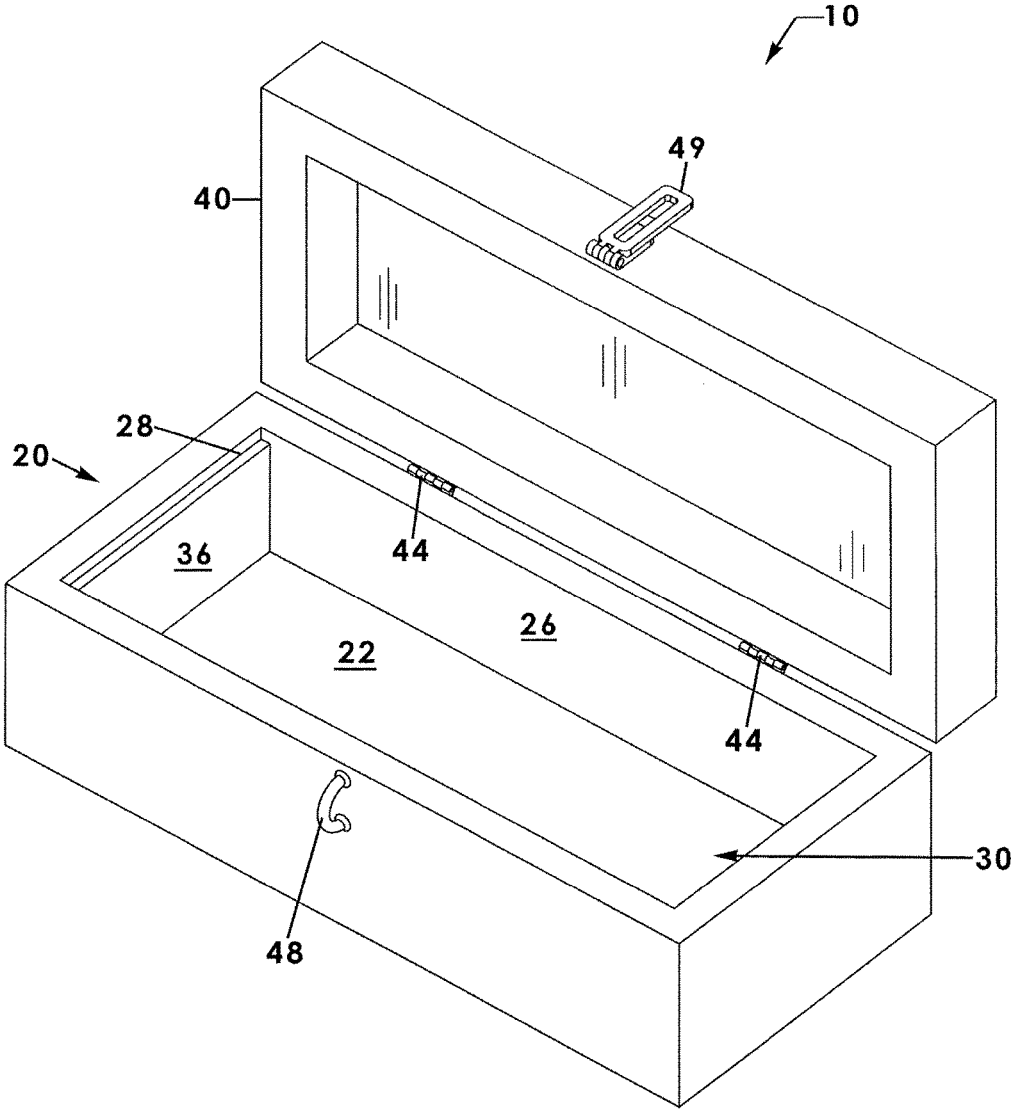
FIG. 4 is another perspective view of the time capsule as in FIG. 3, illustrated with a top wall removed to show the upper chamber.
Figure 5:
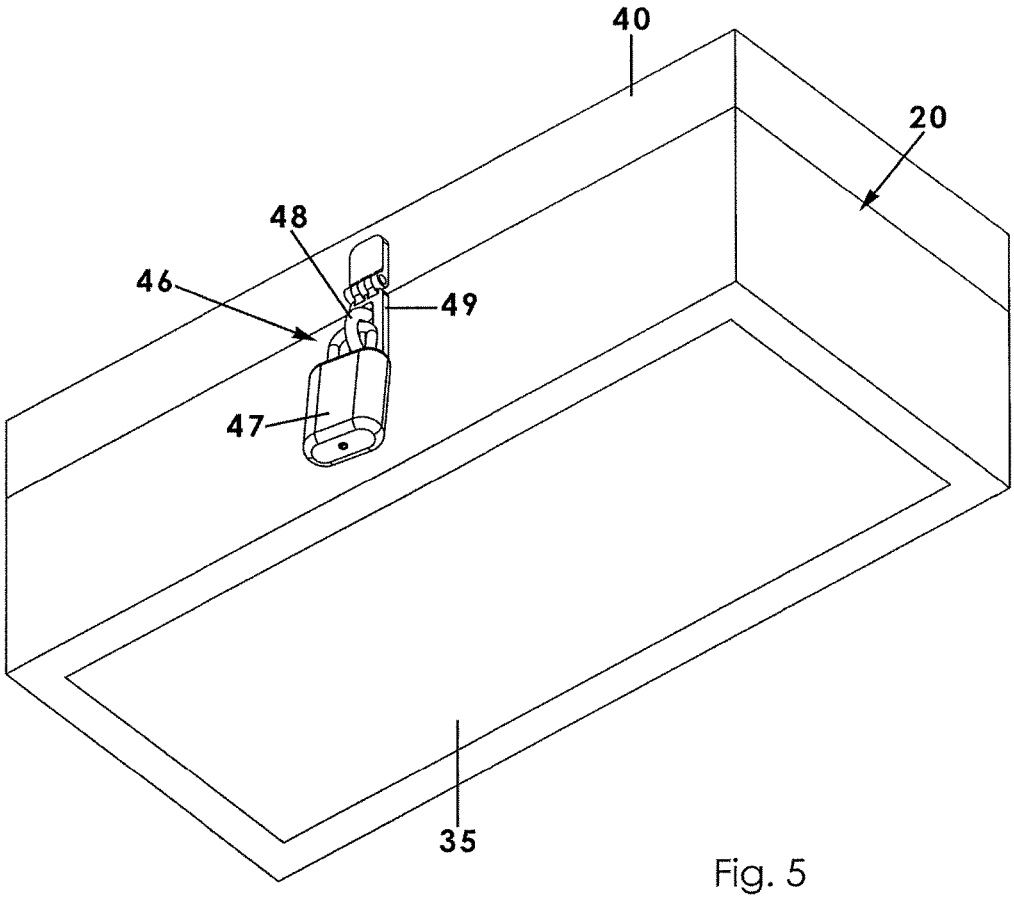
FIG. 5 is a perspective view from a lower angle of a time capsule as in FIG. 1.

The housing 20 may include a lid 40 removably coupled to upper edges of a respective upper side wall 26. In an embodiment, the lid 40 may be pivotally coupled thereto, such as with a hinge 44, and movable between a closed configuration blocking or preventing access to the upper chamber 30 (FIG. 1) and an open configuration allowing access to the upper chamber 30 (FIG. 4). The lid 40 may include a lock 46 configured to selectively hold the lid 40 in the closed configuration. The lock 46 may only be released by operation of the key 50—which is clandestinely situated and hidden in the lower chamber 34.

Now more particularly, the lock 46 includes a base 48 coupled to an outer surface of a respective upper side wall 26. Further, a fastener 49 is coupled to an outer surface of the lid 40, the fastener 49 being pivotally movable between a stowed configuration adjacent the outer surface of the lid 40 (FIG. 4) and a deployed configuration in communication with the base 48 (FIG. 1). The lock 46 also includes an actual lock member 47 that may be positioned in communication with both the fastener 49 and base 48 so that, when actuated (i.e. locked), the fastener 49 and base 48 are locked together and the lid 40 is constrained at the closed configuration—at least until the lock member 47 is released by operation of the key 50. For instance, the lock member 47 may be a padlock in which a toe of a shackle is constrained by a tumbler until released by operation of a key.

Figure 3:
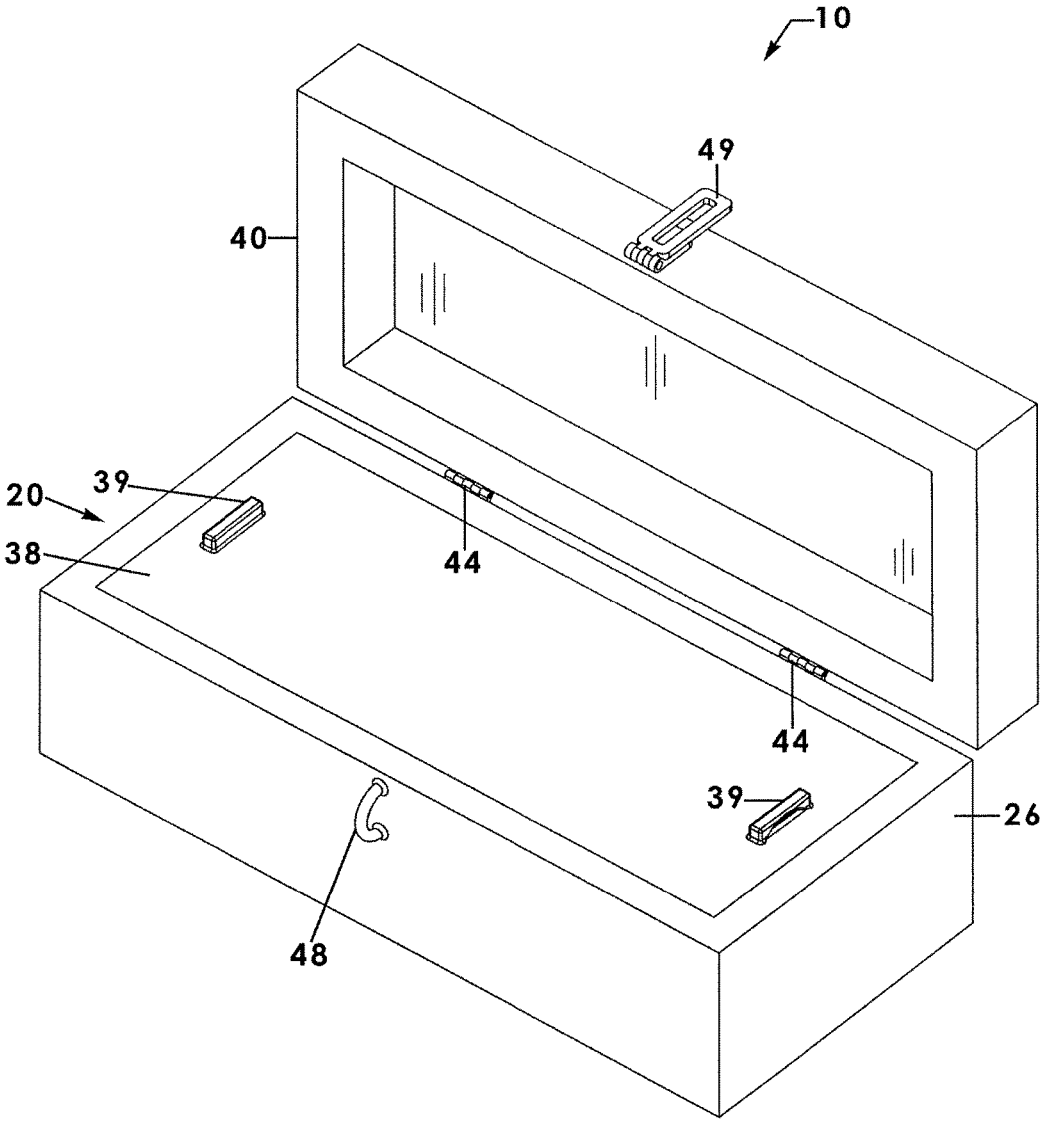
FIG. 3 is another perspective view of the time capsule as in FIG. 1, illustrated in an unlocked and open configuration.

In an embodiment, the housing 20 may include a top wall 38 releasably situated atop the upper side wall 26 thereof. When positioned atop the upper side wall 26, the top wall 38 blocks access to the upper chamber 30 (FIG. 3). By contrast, access is allowed into the upper chamber 30 when the top wall 38 is removed (FIG. 4). In an embodiment, a handle 39 or pair of handles may be coupled to an top surface of the top wall 38, such as adjacent ends thereof, to facilitate a user quickly removing or replacing the top wall 38 into the housing 20. It is understood, of course, that the top wall 38 is removable, replaceable, or provides access to the upper chamber 30 only when the lid 40 is unlocked and opened.

The upper side wall 26, a pair of opposed upper side walls, or the plurality of the upper side walls, collectively, may have a sufficient thickness and be configured to define a ledge 28. In one embodiment, a pair of auxiliary walls 36 may be coupled to respective upper side walls 26 and configured to define the ledge 28. The ledge 28 is configured to receive the top wall 38 in a nested relationship (FIG. 3), whereby to block access to the upper chamber 30.

The lid 40 may include a transparent panel 42 or, in one embodiment, be entirely constructed of a transparent material such as glass, Plexiglas®, or a transparent plastic material. The transparent panel 42 enables a user to view the contents of the upper chamber 30 when the lid 40 is closed/locked—but only if the top wall 38 is not in position as described above. Preferably, however, the contents will remain hidden from view until the lock 46 is opened with the key 50 at the predetermined future date according to the purposes and objects of the present invention.

In use, the time capsule 10 may first be opened and the upper chamber 30 loaded with memorabilia, such as family heirlooms, family photographs, personal letters, and other items of nostalgia. When the user is sure all desired items have been included, he may position the top wall 38 to block view of the upper chamber 30, move the lid 40 to the closed configuration, and secure the lock 46 as described above. The key 50 configured to open the lock 46 will have been situated in the lower chamber 34 at the time of manufacture or may be inserted through a one-way slot (not shown) in the bottom wall 35. When a future user desires to gain access to the time capsule 10—such as on a predetermined date specified on the housing 20, in a last testament and will, or some other indicator—the bottom wall 35 may be broken open, such as with a hammer, screwdriver, or other blunt object and the key 50 may be retrieved (FIG. 6). Finally, the key 50 may be used to release the lock 46 so that the lid 40 may be opened and the plurality of memorabilia may be accessed.

It is understood that while certain forms of this invention have been illustrated and described, it is not limited thereto except insofar as such limitations are included in the following claims and allowable functional equivalents thereof.

The invention claimed is:

1. A time capsule, comprising:

a housing having a floor and at least one upper side wall extending upwardly from a peripheral edge of said floor and at least one lower side wall extending downwardly from said peripheral edge of said floor;

said floor and said at least one upper side wall together define an upper chamber;

said floor and said at least one lower side wall together define a lower chamber;

a bottom wall fixedly attached to lower edges of said at least one lower side wall so as to block access to said lower chamber;

a lid coupled to upper edges of said at least one upper side wall, said lid movable between an open configuration allowing access to said upper chamber and a closed configuration blocking access to said upper chamber, said lid having a lock that holds said lid at said closed configuration until unlocked with a key;

wherein said key is situated in said lower chamber and configured to release said lock.

2. The time capsule as in claim 1, comprising a top wall releasably situated atop said at least one upper wall of said housing so as to selectively block access to said upper chamber when said lid is in said open configuration.

3. The time capsule as in claim 2, wherein said lid includes a transparent panel through which said upper chamber is visible if said top wall is removed.

4. The time capsule as in claim 1, wherein said lid includes a transparent panel through which said upper chamber is visible.

5. The time capsule as in claim 1, wherein said lid is pivotally coupled to said upper edges of said at least one upper side wall with a hinge.

6. The time capsule as in claim 2, wherein a handle is coupled to an upper surface of said top wall by which said top wall is removable from said housing.

7. The time capsule as in claim 1, wherein said at least one upper side wall and said at least one lower side wall are continuous walls, respectively, such that said housing has a cylindrical configuration.

8. The time capsule as in claim 1, wherein said at least one upper side wall is a plurality of upper side walls and said at least one lower side wall is a plurality of lower side walls such that said housing has a rectangular configuration.

9. The time capsule as in claim 1, wherein said lower chamber has a geometric area less than a geometric area of said upper chamber.

10. The time capsule as in claim 1, wherein said bottom wall is constructed of a thin wooden material that is not sturdy against breakage.

11. The time capsule as in claim 1, wherein said at least one upper side wall defines a ledge adjacent said upper edges of said at least one upper side wall, said top wall configured to selectively rest atop said ledge in a nested relationship.

12. The time capsule as in claim 1, wherein said lock includes:

a base coupled to an outer surface of said at least one upper side wall;

a fastener coupled to an outer surface of said lid, said fastener pivotally movable between a stowed configuration adjacent said outer surface of said lid and a deployed configuration in communication with said base;

a lock member configured to constrain said fastener in communication with said base and, as a result, hold said lid at said closed configuration.

13. The time capsule as in claim 1, wherein said key is only removable from said lower chamber when said bottom wall is breached.

* * * * *